US006231973B1

(12) United States Patent
Suematsu et al.

(10) Patent No.: US 6,231,973 B1
(45) Date of Patent: May 15, 2001

(54) THERMAL TRANSFER RECORDING MEDIUM

(75) Inventors: Hideki Suematsu; Seigo Kato, both of Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 09/196,034

(22) Filed: Nov. 18, 1998

(30) Foreign Application Priority Data

Nov. 20, 1997 (JP) ..... 9-319926

(51) Int. Cl.[7] ..... B41M 5/26

(52) U.S. Cl. ..... 428/346; 428/195; 428/354; 428/355 R; 428/355 EN; 428/327

(58) Field of Search ..... 428/500, 522, 428/521, 497, 195, 488.4, 346, 354, 355 R, 355 EN, 327

(56) References Cited

U.S. PATENT DOCUMENTS 5,264,279 * 11/1993 Imamura et al. ..... 428/323
5,654,080 * 8/1997 Hayashi et al. ..... 428/195
5,856,269 * 1/1999 Hayashi et al. ..... 503/227

* cited by examiner

*Primary Examiner*—Pamela R. Schwartz
(74) *Attorney, Agent, or Firm*—Fish & Neave

(57) ABSTRACT

A thermal transfer recording medium is disclosed which comprises a foundation, and an ink layer and an adhesive layer provided on one side of the foundation in this order, the adhesive layer comprising a binder comprising a thermoplastic resin (A) and particles comprising a thermoplastic resin (B) dispersed in the binder, the adhesive layer having an uneven surface resulting from the particles, the thermoplastic resin (A) and the thermoplastic resin (B) being different from each other and the same at least in their main constitutional units.

2 Claims, No Drawings

THERMAL TRANSFER RECORDING MEDIUM

BACKGROUND OF THE INVENTION

The present invention relates to a thermal transfer recording medium. More particularly, it relates to a thermal transfer recording medium having a structure wherein an ink layer and an adhesive layer are provided on a foundation in this order.

A typical example of the thermal transfer recording medium of this type has a structure wherein a heat-meltable or heat-softening ink layer is provided on a foundation. There is also known a thermal transfer recording medium having a structure wherein an adhesive layer is further provided on the ink layer of the foregoing recording medium.

When materials exhibiting sufficient adhesion to a receptor, for example, a polyester resin having a softening point of about 60° C., or the like, are used as a material for the adhesive layer of the thermal transfer recording medium of the aforesaid structure, many of them show fair adhesiveness at ordinary temperatures. Consequently, when the thermal transfer recording medium is stored in such a state that it is wound in the form of a roll, the adhesive layer adheres to the back surface of the foundation in contact with the adhesive layer (this phenomenon is generally called "blocking"), so that difficulty arises in unwinding and dispensing the recording medium in an image formation device, injuring the stability of the recording medium in traveling and eventually inviting the deterioration of image quality. It is also known to add inorganic particles or a wax to the adhesive layer in order to prevent the blocking. However, the addition of the inorganic particles or wax to the adhesive layer is likely to reduce the adhesion to a receptor, thereby causing decreased scratch resistance or falling-off of print images.

The thermal transfer recording medium wherein the adhesive layer is composed of a wax or a resin having relatively high polarity, for example, polyester resin, polyamide resin, cellulosic resin, phenol resin, acrylic resin, or the like has the problem that it does not exhibit sufficient adhesion to a receptor made of a resin having a relatively low surface tension such as polyethylene or polypropylene.

In view of the foregoing, an object of the present invention is to provide a thermal transfer recording medium which exhibits sufficient adhesion to various receptors and does not cause blocking.

This and other objects of the present invention will become apparent from the description hereinafter.

SUMMARY OF THE INVENTION

In accordance with a first feature of the present invention, there is provided a thermal transfer recording medium comprising a foundation, and an ink layer and an adhesive layer provided on one side of the foundation in this order, the adhesive layer comprising a binder comprising a thermoplastic resin (A) and particles comprising a thermoplastic resin (B) dispersed in the binder, the adhesive layer having an uneven surface resulting from the particles, the thermoplastic resin (A) and the thermoplastic resin (B) being different from each other and the same at least in their main constitutional units.

In a second feature of the present invention, there is provided the thermal transfer recording medium of the first feature, wherein the thermoplastic resin (B) has a greater average molecular weight than the thermoplastic resin (A) so that the thermoplastic resin (B) has smaller solubility to the solvent of a coating liquid for the adhesive layer than the thermoplastic resin (A), and the particles comprising the thermoplastic resin (B) maintains the particle form in the adhesive layer.

In a third feature of the present invention, there is provided the thermal transfer recording medium of the first feature, wherein the thermoplastic resin (B) has a greater crystallinity than the thermoplastic resin (A) so that the thermoplastic resin (B) has smaller solubility to the solvent of a coating liquid for the adhesive layer than the thermoplastic resin (A), and the particles comprising the thermoplastic resin (B) maintains the particle form in the adhesive layer.

In a fourth feature of the present invention, there is provided the thermal transfer recording medium of the first, second or third feature, wherein the thermoplastic resin (A) and the thermoplastic resin (B) are each a member selected from the group consisting of a propylene resin, an ethylene-vinyl acetate copolymer, an acrylic resin, a polyester resin, a polyethylene resin, a polystyrene resin, a polybutene resin, a rosin resin, a terpene resin, a vinyl chloride resin and an epoxy resin.

In a fifth feature of the present invention, there is provided the thermal transfer recording medium of the first, second, third or fourth feature, wherein the thermoplastic resin (A) and the thermoplastic resin (B) are each a maleic anhydride-modified polypropylene resin, and the maleic anhydride-modified polypropylene resin as the thermoplastic resin (A) has a weight average molecular weight of not less than $2\times10^4$ to less than $4\times10^4$ and the maleic anhydride-modified polypropylene resin as the thermoplastic resin (B) has a weight average molecular weight of more than $4\times10^4$.

In a sixth feature of the present invention, there is provided the thermal transfer recording medium of the first, second, third, fourth or fifth feature. wherein the thermoplastic resin (A) and the thermoplastic resin (B) are each a maleic anhydride-modified polypropylene resin having an addition ratio of maleic anhydride of 1 to 7% by weight.

DETAILED DESCRIPTION

The thermal transfer recording medium of the present invention is characterized by comprising a foundation, and an ink layer and an adhesive layer provided on one side of the foundation in this order, the adhesive layer comprising a binder comprising a thermoplastic resin (A) and particles comprising a thermoplastic resin (B) dispersed in the binder, the adhesive layer having an uneven surface resulting from the particles, the thermoplastic resin (A) and the thermoplastic resin (B) being different from each other and the same at least in their main constitutional units.

Herein, the concept that the thermoplastic resin (A) and the thermoplastic resin (B) are different from each other and the same at least in their main constitutional units means as follows: The term "constitutional unit" usually refers to recurring unit. In the case of a homopolymer, there is one kind of constitutional unit (recurring unit) and this is the main constitutional unit. For example, two polypropylenes, two polyethylenes, two polystyrenes, two poly(meth)acrylic acid esters or two polyesters (comprising one kind of dicarboxylic acid component and one kind of diol component) which are different from each other in molecular weight fall under the category of the thermoplastic resins (A) and (B). In the case of a copolymer (including polycondensation products), there are two or more kinds of the main constitutional units (recurring units). For example, in the case of chlorinated polypropylenes, the propylene unit and the chlorinated propylene unit are the main constitutional units. Two chlorinated polypropylenes which each comprise these two kinds of constitutional units and are different from each other in polymerization degree or addition ratio of chlorine fall under the category of the thermoplastic resins (A) and (B). Further, the thermoplastic resin (A) and the thermoplastic resin (B) satisfy the requirement so long as at least the main constitutional units of both are same. When this is explained using polypropylene resins for an example, a propylene homopolymer and a propylene copolymer fall under the category of the thermoplastic resin (A) and (B) because the main constitutional units of both are the same, provided that the comonomer unit in the propylene copolymer is minor in quantity.

When the thermal transfer recording medium of the above-mentioned constitution is stored in the state where it is wound in the form of a roll, the particles of the thermoplastic resin (B) projecting from the surface of the adhesive layer reduce the contact area between the surface of the adhesive layer and the back surface of the foundation, thereby preventing the blocking. Further, when the thermal transfer recording medium of the above-mentioned constitution is used for thermal transfer, not only the thermoplastic resin (A) as the binder is softened to show adhesion to a receptor but also the particles of thermoplastic resin (B) which is the same as the thermoplastic resin (A) at least in the main constitutional unit are also softened to some extent to show adhesion to the receptor. Thus the hindrance of the adhesion of the binder to a receptor by the particles as in the prior art is not caused, resulting in excellent transferability.

Moreover, when a coating liquid for the adhesive layer is prepared by adding the particles of the thermoplastic resin (B) to a solution of the thermoplastic resin (A) as a binder in a solvent, the particles of the thermoplastic resin (B) hardly separate out or precipitate in the coating liquid due to its excellent dispersibility, resulting in an adhesive layer in which the particles are uniformly dispersed. This in cooperation with the phenomenon that the thermoplastic resins (A) and (B) are softened and partially dissolved into each other in thermal transfer results in print images having no voids.

Furthermore, the thermal transfer recording medium of the present invention is effective for forming print images on a receptor which is composed of a resin having a relatively small surface tension such as polyethylene or polypropylene and to which the print image obtainable by use of the conventional thermal transfer recording medium is difficult to adhere. For instance, the use of an adhesive layer comprising a polypropylene resin as the binder and particles of another polypropylene resin having the same constitutional unit imparts favorable adhesion to a receptor composed of polyethylene or polypropylene when thermal transfer to the resulting thermal transfer recording medium.

As described above, in the present invention, two kind of thermoplastic resins which are at least the same in their main constitutional units are used as the thermoplastic resin (A) for the binder of the adhesive layer and as the thermoplastic resin (B) for the particles.

For this reason, it possible to maintain the particles comprising the thermoplastic resin (B) in the particle form thereof in the formation of the adhesive layer. Examples of such means are as follows:

(1) A difference in the solubility to the solvent of the coating liquid for the adhesive layer is provided between the thermoplastic resins (A) and (B) so that the thermoplastic resin (A) is readily dissolved into the solvent and the thermoplastic resin (B) is not dissolved or hardly dissolved, thereby maintaining the particle form of the particles comprising the thermoplastic resin (B).

The difference in molecular weight, crystallinity or the like can be utilized as the means for providing the difference in the solubility between the thermoplastic resins (A) and (B). For instance, a resin having a small average molecular weight is used as the thermoplastic resin (A) and another resin having a greater average molecular weight is used as the thermoplastic resin (B). In another example, a resin having a small crystallinity is used as the thermoplastic resin (A) and another resin having a greater crystallinity is used as the thermoplastic resin (B).

(2) Even though there is no difference between the thermoplastic resins (A) and (B) in the solubility to the solvent for the adhesive layer when being heated, a means can be adopted wherein a resin for the thermoplastic resin (A) is dissolved into a solvent under heating and then cooled to give a solution, and another resin for the thermoplastic resin (B) is pulverized and dispersed in the solvent at ordinary temperatures to give a dispersion, and the solution and the dispersion are mixed and used as the coating liquid for the adhesive layer.

The thermoplastic resin (A) and the thermoplastic resin (B) useful in the present invention are, for example, a member selected from the group consisting of polypropylene resins, ethylene-vinyl acetate copolymers, acrylic resins such as poly(meth)acrylic acid esters, polyester resins, polyethylene resins, polystyrene resins, polybutene resins, rosin resins, terpene resins, vinyl chloride resins and epoxy resins.

Polypropylene resins are preferably used as the thermoplastic resins (A) and (B) for obtaining an adhesive layer showing good adhesion to even a receptor composed of a resin having a relatively small surface tension such as polyethylene or polypropylene. Useful as the polypropylene resins are usual polypropylene resins and modified polypropylene resins.

Preferred polypropylene resins are polypropylene resins in which polar groups are introduced because the performance of the resulting print images are good and it is easy to obtain two resins between which there is the difference in the solubility to the solvent for the coating liquid. From these viewpoints, chlorinated polypropylene resins and maleic anhydride-modified polypropylene resins are especially preferred.

When chlorinated polypropylenes or maleic anhydride-modified polypropylene resins are used and the difference in the solubility to the solvent in the coating liquid for the adhesive layer is provided by the difference in molecular weight between two resins, it is preferable to use a resin having a weight average molecular weight of not less than $2\times10^4$ to less than $4\times10^4$ for the thermoplastic resin (A) and another resin having a weight average molecular weight of not less than $4\times10^4$ for the thermoplastic resin (B). Chlorinated polypropylenes or maleic anhydride-modified polypropylene resins having a weight average molecular weight of less than $2\times10^4$ are not suitable for the thermoplastic resin (A) because these resins show adhesiveness even at ordinary temperatures, resulting in difficulty in preventing blocking. Chlorinated polypropylenes or maleic anhydride-modified polypropylene resins having a weight average molecular weight of not less than $4\times10^4$ are not suitable for the thermoplastic resin (A) because these resins have low solubility to the solvent for the coating liquid. Chlorinated polypropylenes or maleic anhydride-modified polypropylene resins having a weight average molecular weight of less than $4\times10^4$ are not suitable for the thermoplastic resin (B) because these resins are poor in preventing blocking and are partially dissolved into the solvent for the coating liquid, causing gelation. In order to provide the difference in the solubility to the solvent for the coating liquid, it is preferable that the difference in weight average molecular weight between a resin for the thermoplastic resin (A) and another resin for the thermoplastic resin (B) is not less than $2\times10^4$.

Chlorinated polypropylene resins useful for the thermoplastic resins (A) and (B) preferably have an addition ratio of chlorine of 10 to 30% by weight. Herein the addition ratio of chlorine refers to the ratio (% by weight) of the amount of the chlorine added to the whole amount of the chlorinated polypropylene resin. Chlorinated polypropylene resins having an addition ratio of chlorine of less than the above range are liable to show insufficient adhesion when being used as the thermoplastic resin (A). Chlorinated polypropylene resins having an addition ratio of chlorine of more than the above range are liable to show insufficient effect of preventing blocking when being used as the thermoplastic resin (B).

Preferred chlorinated polypropylene resins useful for the thermoplastic resins (A) and (B) have an addition ratio of chlorine of 10 to 30% by weight and a weight average molecular weight within the aforesaid range.

Even when two chlorinated polypropylene resins which have the same addition ratio of chlorine and the same weight average molecular weight are used for the thermoplastic resins (A) and (B), it is possible to provide the difference in solubility to the solvent for the coating liquid between these resins if there is any difference in crystallinity between the two resins.

Maleic anhydride-modified polypropylene resins useful for the thermoplastic resins (A) and (B) preferably have an addition ratio of maleic anhydride of 1 to 7% by weight. Herein the addition ratio of maleic anhydride refers to the ratio (% by weight) of the amount of the maleic anhydride added to the whole amount of the maleic anhydride-modified polypropylene resin. Maleic anhydride-modified polypropylene resins having an addition ratio of maleic anhydride of less than the above range are liable to show insufficient adhesion when being used as the thermoplastic resin (A). Maleic anhydride-modified polypropylene resins having an addition ratio of maleic anhydride of more than the above range are liable to show insufficient effect of preventing blocking when being used as the thermoplastic resin (B).

Preferred maleic anhydride-modified polypropylene resins useful for the thermoplastic resins (A) and (B) have an addition ratio of maleic anhydride of 1 to 7% by weight and a weight average molecular weight within the aforesaid range.

Even when two maleic anhydride-modified polypropylene resins which have the same addition ratio of maleic anhydride and the same weight average molecular weight are used for the thermoplastic resins (A) and (B), it is possible to provide the difference in solubility to the solvent for the coating liquid between these resins if there is any difference in crystallinity between the two resins.

When acrylic resins such as poly(meth)acrylic acid esters are used for the thermoplastic resins (A) and (B), it is preferable to use a resin having a weight average molecular weight of not less than $1\times10^4$ to less than $5\times10^4$ for the thermoplastic resin (A) and another resin having a weight average molecular weight of not less than $5\times10^4$ to not more than $40\times10^4$. Acrylic resins having a weight average molecular weight of less than $1\times10^4$ are not suitable for the thermoplastic resin (A) because these resins have low melt viscosity when being transferred, resulting in failure to provide print images with good reproducibility. Acrylic resins having a weight average molecular weight of not less than $5\times10^4$ are not suitable for the thermoplastic resin (A) because the use of these resins results in poor transferability to fail to obtain print images with fine definition. Acrylic resins having a weight average molecular weight of less than $5\times10^4$ are not suitable for the thermoplastic resin (B) because these resins are poor in preventing blocking. Acrylic resins having a weight average molecular weight of more than $40\times10^4$ are not suitable for the thermoplastic resin (B) because the use of these resins results in transfer hindrance. In order to provide the difference in solubility to the solvent for the coating liquid, it is preferable that the difference in weight average molecular weight between an acrylic resin for the thermoplastic resin (A) and another acrylic resin for the thermoplastic resin (B) is not less than $10\times10^4$.

From the viewpoint of transfer sensitivity, the thermoplastic resin (A) as a binder preferably has a softening point of 50° to 90° C. The softening point of the thermoplastic resin (B) is not particularly limited. However, the thermoplastic resin (B) preferably has a softening point of 90° to 130° C. because it is desirable that the particles comprising the thermoplastic resin (B) are partially softened to show adhesiveness when being thermally transferred.

According to the constitution of the present invention wherein two different thermoplastic resins having at least the same main constitutional unit are used, respectively, for the thermoplastic resin (A) as the binder of the adhesive layer and for the thermoplastic resin (B) as the material for the particles, it is possible to use as the thermoplastic resin (A) a resin which shows sufficient adhesion to a receptor and provides good transferability when being thermally transferred (however, it is liable to cause blocking at ordinary temperatures) and as the thermoplastic resin (B) another resin which shows such a degree of adhesion that the adhesiveness of the thermoplastic resin (A) is not hindered when being thermally transferred and exhibits strong effect of preventing blocking at ordinary temperatures, thereby providing a thermal transfer recording medium which shows sufficient adhesion to a receptor when being thermally transferred and is satisfactorily prevented from blocking at ordinary temperatures.

The coating amount (on a dry basis, hereinafter the same) of the adhesive layer is preferably from 0.1 to 5 $g/m^2$, more preferably from 0.1 to 2 $g/m^2$. When the coating amount is smaller than the above range, the adhesion to a receptor is liable to become insufficient, resulting in poor transferability. When the coating amount is larger than the above range, the transfer sensitivity is liable to become poor.

The particles comprising the thermoplastic resin (B) preferably have an average particle size of not less than 0.1 $\mu$m, more preferably not less than 1 $\mu$m in order that the particles project from the surface of the adhesive layer. On the other hand, when the average particle size of the particles is excessively large, the transferability is liable to become poor. Therefore, the average particle size is preferably not more than 50 $\mu$m, more preferably not more than 20 $\mu$m.

When the content of the particles in the adhesive layer is excessively small, the effect of preventing blocking becomes poor. When the content of the particles in the adhesive layer is excessively large, adhesion become poor. From these viewpoints, the content of the particles is preferably from 0.1 to 80% by weight, more preferably from 5 to 60% by weight.

The adhesive layer can be incorporated with an additive such as plasticizer, antifoaming agent, surface active agent or antioxidant as required so long as the object of the present invention is not injured.

The adhesive layer can be formed by applying onto the ink layer a coating liquid wherein the thermoplastic resin (A) is dissolved and the thermoplastic resin (B) is dispersed in a solvent, followed by drying.

As the ink layer in the present invention, there can be used any conventional thermal transfer ink layers each comprising a coloring agent and a vehicle which is heat-meltable or heat-softening (or neither heat-meltable nor heat-softening) without any particular limitation. Useful as the vehicles are conventional ones without any particular limitation, for example, those composed of at least one of a thermoplastic resin and a wax as a main component.

Examples of the thermoplastic resins (inclusive of elastomers) include ethylene copolymers such as ethylene-vinyl acetate copolymer, ethylene-vinyl butyrate copolymer, ethylene-(meth)acrylic acid copolymer, ethylene-alkyl (meth)acrylate copolymer, ethylene-acrylonitrile copolymer, ethylene-acrylamide copolymer, ethylene-N-methylolacrylamide copolymer and ethylene-styrene copolymer, (meth)acrylic acid ester resin, vinyl chloride resins such as polyvinyl chloride, vinyl chloride-vinyl acetate copolymer and vinyl chloride-vinyl alcohol copolymer, polyester resins, polyamide resins, epoxy resins, phenol resins, acetophenone-formaldehyde resins, cellulosic resins, natural rubber, styrene-butadiene copolymer, isoprene polymer, chloroprene polymer, petroleum resins, styrene resins, rosin resins, terpene resins and cumarone-indene resin. These resins may be used either alone or in combination of two or more species thereof.

Examples of the waxes include natural waxes such as lanolin, carnauba wax, candelilla wax, montan wax and ceresine wax; petroleum waxes such as paraffin wax and microcrystalline wax; synthetic waxes such as oxidized waxes, synthetic ester waxes, low molecular weight polyethylene wax, α-olefin-maleic anhydride copolymer wax, urethane wax, Fischer-Tropsch wax and synthetic petroleum waxes. These waxes may be used either alone or in combination of two or more species thereof.

Useful as the coloring agent are carbon black as well as organic or inorganic coloring pigments and dyes commonly used for thermal transfer recording media of this type. The content of the coloring agent in the ink layer is preferably from about 20 to 60% by weight.

The ink layer can be incorporated with a curing agent such as polyisocyanate, a plasticizer, a surface active agent, a dispersing agent for pigments, an antistatic agent, or the like, as required, besides the above-mentioned components.

The ink layer can be formed as follows: The above-mentioned vehicle component is dissolved in a suitable solvent. To the solution are added the coloring agent and other additives as required to give a coating liquid. The coating liquid is applied onto a foundation and dried. The ink layer can also be formed by a hot-melt coating method.

The coating amount of the ink layer is suitable from about 0.1 to about 5 g/m$^2$ from the viewpoint of the transfer sensitivity and the optical density of print images.

In the present invention, a release layer composed of a wax as a main component may be provided between the foundation and the ink layer to improve the transfer sensitivity, as required.

As the foundation for the thermal transfer recording medium of the present invention, there can be used polyester films such as polyethylene terephthalate film, polyethylene naphthalate film and polyarylate film, polycarbonate film, polyamide film, aramide film, and other various plastic films commonly used for the foundation film of the thermal transfer recording media of this type. Thin paper sheets of high density such as condenser paper can also be used. The thickness of the foundation is usually from about 1 to about 10 μm. From the viewpoint of reducing heat spread to increase the resolution of print images, the thickness of the foundation is preferably from 1 to 6 μm.

In the case that the thermal transfer recording medium of the present invention used in an image formation device equipped with a thermal head, a conventional stick-preventive layer may be provided on the back side (the side adapted to come into slide contact with the thermal head ) of the foundation. Examples of the materials for the stick-preventive layer include various heat-resistant resins such as silicone resins, fluorine-containing resins and nitrocellulose resins, and other resins modified with these resins, such as silicone-modified urethane resin and silicone-modified acrylic resins, and mixtures of the foregoing heat-resistant resins and lubricating agents.

The thermal transfer recording medium of the present invention is applicable to cases where heat sources for thermal transfer other than the thermal head are used. Other heat sources include laser ray, and the like.

The present invention will be more fully described by way of Examples and Comparative Examples thereof. It is to be understood that the present invention is not limited to these Examples, and various changes and modifications may be made in the invention without departing from the spirit and scope thereof.

EXAMPLE 1

A 6 μm-thick polyethylene terephthalate film with a stick-preventive layer composed of a silicone resin on one side thereof was used as a foundation. Onto the opposite side of the foundation with respect to the stick-preventive layer was applied the ink of the following formula by a hot-melt coating method to form an ink layer in a coating amount of 2.0 g/m$^2$.

Ink composition

| Component | Parts by weight |
|---|---|
| Paraffin wax | 20 |
| Carnauba wax | 50 |
| Carbon black | 30 |

Onto the ink layer was applied the coating liquid for the adhesive layer of the following formula by a gravure coating method and dried to give an adhesive layer in a coating amount of 1.0 g/m$^2$, yielding a thermal transfer recording medium.

Coating liquid for adhesive layer

| Component | Parts by weight |
|---|---|
| Polymethyl methacrylate (A) (softening point: 80° C., weight average molecular weight: 40 × 10$^3$) | 19 |
| Particles of polymethyl methacrylate(B) (softening point: 100° C., weight average molecular weight: 30 ×10$^4$, average particle size: 5 μm) | 1 |
| Methyl ethyl ketone | 40 |
| Toluene | 40 |

EXAMPLE 2

The same procedures as in Example 1 were repeated to form a thermal transfer recording medium except that the coating liquid of the following formula was used as the coating liquid for the adhesive layer.

| Coating liquid for adhesive layer | |
|---|---|
| Component | Parts by weight |
| Chlorinated polypropylene (A) (softening point: 70° C., weight average molecular weight: 25 × $10^3$, addition ratio of chlorine: 11% by weight) | 10 |
| Particles of chlorinated polypropylene (B) (softening point: 90° C., weight average molecular weight: 60 × $10^3$, addition ratio of chlorine: 11% by weight, average particle size: 7 μm) | 10 |
| Toluene | 60 |
| Methyl ethyl ketone | 10 |
| Butyl acetate | 10 |

EXAMPLE 3

The same procedures as in Example 1 were repeated to form a thermal transfer recording medium except that the coating liquid of the following formula was used as the coating liquid for the adhesive layer.

| Coating liquid for adhesive layer | |
|---|---|
| Component | Parts by weight |
| Maleic anhydride-modified polypropylene (A) (softening point: 75° C., weight average molecular weight: 30 × $10^3$, addition ratio of maleic anhydride: 6% by weight) | 8 |
| Particles of maleic anhydride-modified polypropylene (B) (softening point: 100° C., weight average molecular weight: 60 × $10^3$, addition ratio of maleic anhydride: 6% by weight, average particle size: 10 μm) | 2 |
| Toluene | 90 |

EXAMPLE 4

Onto the one side of the film foundation used in Example 1 was applied the composition for release layer of the following formula by a hot-melt coating method to give a release layer in a coating amount of 1.0 g/$m^2$.

| Composition for release layer | |
|---|---|
| Component | Parts by weight |
| Paraffin wax | 20 |
| Carnauba wax | 70 |
| Ethylene-vinyl acetate copolymer | 10 |

Onto the release was applied the coating liquid for ink layer of the following formula by a gravure coating method to give an ink layer in a coating amount of 2.0 g/$m^2$.

| Coating liquid for ink layer | |
|---|---|
| Component | Parts by weight |
| Polyester resin | 10 |
| Polystyrene resin | 4 |
| Carbon black | 6 |
| Toluene | 60 |
| Methyl ethyl ketone | 15 |
| Butyl acetate | 5 |

Onto the ink layer was formed the same adhesive layer as in Example 3 to give a thermal transfer recording medium.

COMPARATIVE EXAMPLE 1

The same procedures as in Example 1 were repeated to form a thermal transfer recording medium except that the coating liquid of the following formula was used as the coating liquid for the adhesive layer.

| Coating liquid for adhesive layer | |
|---|---|
| Component | Parts by weight |
| Polymethyl methacrylate (A) used in Example 1 | 20 |
| Methyl ethyl ketone | 80 |

COMPARATIVE EXAMPLE 2

The same procedures as in Example 1 were repeated to form a thermal transfer recording medium except that the coating liquid of the following formula was used as the coating liquid for the adhesive layer.

| Coating liquid for adhesive layer | |
|---|---|
| Component | Parts by weight |
| Maleic anhydride-modified polypropylene (A) used in Example 3 | 20 |
| Toluene | 80 |

COMPARATIVE EXAMPLE 3

The same procedures as in Example 1 were repeated to form a thermal transfer recording medium except that the coating liquid of the following formula was used as the coating liquid for the adhesive layer.

| Coating liquid for adhesive layer | |
|---|---|
| Component | Parts by weight |
| Polymethyl methacyrate (A) used in Example 1 | 19 |
| Silica powder (average particle size: 2.0 μm) | 1 |
| Methyl ethyl ketone | 90 |

With respect to each of the thus obtained thermal transfer recording media, the following tests were conducted. The results thereof are shown in Table 1.

(1) Transferability

With use of a bar code printer (B-30 made by TEC Corp.), bar codes were printed under the following printing conditions. The obtained bar code images were read with a bar code reader and the transferability was evaluated on the basis of the following criterion.

Printing condition

Printing energy: ±0 V (the value prescribed in the printer used)

Printing speed: 2 inches/second

Receptor: polypropylene (PP) film or acryl resin-coated paper sheet

Evaluation criterion

○ The images were readable with the bar code reader and visually clear.

Δ The images were readable with the bar code reader but visually somewhat lacked a fine definition.

X The images were not readable with the bar code reader.

(2) Fixing property of print image

A cellophane tape was adhered to the printed matter obtained in the above (1) under a pressure of 2 kg/cm$^2$. After the cellophane tape was peeled off, the images were read with the bar code reader and the fixing strength was evaluated on the basis of the following criterion. This test was not carried out for the case where the transferability was rated "X".

Evaluation criterion

○ The images were readable with the bar code reader.

Δ The images were difficult to read with the bar code reader but the ink was present in a larger amount on the receptor side than on the cellophane tape side.

X The ink was present in a larger amount on the cellophane tape side than the receptor side.

(3) Scratch resistance

The printed matter obtained in the above (1) was rubbed with a cotton cloth under a load of 200 g/cm$^2$ given times and thereafter the images were read with the bar code reader. The scratch resistance was evaluated on the basis of the following criterion. This test was not carried out for the case where the transferability was rated "X".

Evaluation criterion

○ The images were readable with the bar code reader after the rubbing operation 50 times.

Δ The images were impossible to read with the bar code reader after the rubbing operation 50 times but readable after the rubbing operation 20 times.

X The images were impossible to read with the bar code reader after the rubbing operation 20 times.

(4) Antiblocking proerty

Each thermal transfer recording medium (300 m in length) was wound on a core having a diameter of 34 mm and the resulting roll was allowed to stand at 50° C., 85% RH for 96 hours. The antiblocking property was evaluated on the basis of the following criterion.

○ Blocking occurred.

X Blocking did not occur.

TABLE 1

| | Ex.1 | Ex.2 | Ex.3 | Ex.4 | Com. Ex.1 | Com. Ex.2 | Com. Ex.3 |
|---|---|---|---|---|---|---|---|
| Transferability | | | | | | | |
| PP Film | X | ○ | ○ | ○ | X | ○ | X |
| Acryl-coated paper | ○ | ○ | ○ | ○ | ○ | ○ | X |
| Fixing strength | | | | | | | |
| PP Film | — | ○ | ○ | ○ | — | ○ | — |
| Acryl-coated paper | ○ | ○ | ○ | ○ | ○ | ○ | — |
| Scratch resistance | | | | | | | |
| PP Film | — | Δ | Δ | ○ | — | Δ | — |
| Acryl-coated paper | Δ | Δ | Δ | ○ | Δ | Δ | — |
| Antiblocking property | ○ | ○ | ○ | ○ | X | X | X |

In addition to the materials and ingredients used in the Examples, other materials and ingredients can be used in the present invention as set forth in the specification to obtain substantially the same results.

The thermal transfer recording medium of the present invention shows sufficient adhesion to a receptor and provides print images excellent in scratch resistance with excellent transferability, and does not cause blocking. Especially when modified polypropylene resins are used for the binder of the adhesive layer and for the particles, the thermal transfer recording medium shows excellent adhesion to even receptors such as polyethylene film and polypropylene film.

What is claimed is:

1. A thermal transfer recording medium comprising a foundation, an ink layer and an adhesive layer provided on one side of the foundation in that order;

wherein the adhesive layer is the outermost layer of the thermal transfer recording medium opposite the foundation;

wherein the adhesive layer comprises a binder comprising a thermoplastic resin (A) and particles comprising a thermoplastic resin (B) dispersed in the binder, the adhesive layer having an uneven surface resulting from the particles, the thermoplastic resin (A) and the thermoplastic resin (B) being different from each other in solubility in a solvent of a coating liquid for the adhesive layer;

wherein the thermoplastic resin (A) and the thermoplastic resin (B) are the same in their main constitutional units by quantity; and wherein the thermoplastic resin (A) and the thermoplastic resin (B) are each a maleic anhydride-modified polypropylene resin, and the maleic anhydride-modified polypropylene resin as the thermoplastic resin (A) has a weight average molecular weight of not less than $2\times10^4$ to less than $4\times10^4$ and the maleic anhydride-modified polypropylene resin as the thermoplastic resin (B) has a weight average molecular weight of more than $4\times10^4$.

2. The thermal transfer recording medium of claim 1, wherein the thermoplastic resin (A) and the thermoplastic resin (B) are each a maleic anhydride-modified polypropylene resin having an addition ratio of maleic anhydride of 1 to 7% by weight.

* * * * *